US005446486A

United States Patent [19]

Reis

[11] Patent Number: 5,446,486

[45] Date of Patent: Aug. 29, 1995

[54] LIQUID-JET PRINTER DEVICE

[75] Inventor: Theo Reis, Mölnlycke, Sweden

[73] Assignee: Markpoint System AB, Sweden

[21] Appl. No.: 853,742

[22] PCT Filed: Dec. 11, 1990

[86] PCT No.: PCT/EP90/02125

§ 371 Date: Jun. 5, 1992

§ 102(e) Date: Jun. 5, 1992

[87] PCT Pub. No.: WO91/08903

PCT Pub. Date: Jun. 27, 1991

[30] Foreign Application Priority Data

Dec. 12, 1989 [SE] Sweden ..... 8904182

[51] Int. Cl.[6] ..... B41J 2/175

[52] U.S. Cl. ..... 347/85; 347/84

[58] Field of Search ..... 347/84, 85

[56] References Cited

U.S. PATENT DOCUMENTS

| | | | |
|---|---|---|---|
| 4,152,710 | 5/1979 | Matsuba et al. | 347/85 |
| 4,207,582 | 6/1980 | Yamamoto . | |
| 4,337,469 | 6/1982 | Takano et al. | 347/85 X |
| 4,555,719 | 11/1985 | Arway et al. | 347/85 |
| 5,220,345 | 6/1993 | Hirosawa | 347/85 |

FOREIGN PATENT DOCUMENTS

| | | | |
|---|---|---|---|
| 0044751 | 1/1982 | European Pat. Off. . | |
| 0277453 | 8/1988 | European Pat. Off. . | |
| 2450161 | 9/1980 | France . | |
| 2916881 | 11/1979 | Germany . | |
| 2828998 | 1/1980 | Germany | 347/85 |
| 0130363 | 10/1981 | Japan | 347/84 |
| 0203562 | 12/1982 | Japan | 347/85 |
| 0198253 | 10/1985 | Japan | 347/84 |
| 0037955 | 2/1988 | Japan | 347/85 |

OTHER PUBLICATIONS

IBM Technical Disclosure Bulletin, vol. 22, No. 10, Mar. 1980, "Start/Stop Valve for Ink Jet Printer," by K. R. Primmer.

IBM Technical Disclosure Bulletin, vol. 18, No. 10, Mar. 1976, "Ink Jet Head," by R. E. Pelkie, N. C. Smith and R. E. Tomek.

PCT International Search Report, 90/02125, Apr. 2, 1991.

*Primary Examiner*—Matthew S. Smith

*Attorney, Agent, or Firm*—Lerner, David, Littenberg, Krumholz & Mentlik

[57] ABSTRACT

Liquid jet printer device for recording information on an information carrier in the form of characters or symbols. A print head forms a part of the device and a plurality of liquid channels are arranged therein to discharge a series of liquid jets or liquid droplets according to a predetermined pattern during predetermined printing periods. The liquid channels in the print head present outlet openings for the discharge of print liquid under pressure, and valves included therein, switchable for opening and closing respectively the liquid channels. Inlet ends connect the liquid channels to a supply conduit for delivery of print liquid via a pump under pressure from a liquid container. The device maintains an operating pressure in the supply conduit only during those printing periods during which printing takes place. Pressure relief occurs during idle periods between printing periods to atmospheric pressure or subatmospheric pressure. During the idle periods, a small return flow of print liquid occurs so that the outlet openings are substantially emptied of print liquid.

10 Claims, 2 Drawing Sheets

LIQUID-JET PRINTER DEVICE

TECHNICAL FIELD

The present invention relates to a liquid-jet printer device for recording information on an information carrier in the form of characters or symbols and including a print head in which a plurality of liquid channels are arranged to discharge a series of liquid jets or liquid droplets according to a predetermined pattern during predetermined printing periods, whereby the liquid channels in the print head present outlet openings for discharge of the print liquid under pressure and within which valve parts are arranged, switchable for opening and closing respectively of the liquid channels, and inlet ends for connection of the liquid channels to a supply conduit for supply of print liquid by means of a pump arrangement under pressure from a liquid container.

BACKGROUND OF THE INVENTION

In liquid-jet printers, more particularly matrix printers for large printing with individually printed characters or symbols which, depending on a control unit, are continually changed, very high demands are made on the grouping of those valves which are located in each individual channel and which switch between open and closed positions in order to eject those liquid droplets under pressure which, according to a pattern determined by the control unit, are ejected onto an object which, for instance, moves past the print head. With unsatisfactory grouping of the valves, a risk of leakage arises such that the print liquid collects in the outlet openings of the print head also during periods between each print moment, for example, during changing from one object to another. Thus there is a risk that the print liquid thickens and dries due to its exposure to air, with the subsequent risk of blocking the outlet openings in the print head.

The above problem can be partially solved by manufacturing the valves with high quality seals, though in practice a certain amount of wear nevertheless occurs and thus periods of reduced sealing and risk of leakage arise. Even with high quality seals, a small quantity of print liquid remains in the outlet openings, with the risk of blockage if the intervals between the print moments are too long.

SUMMARY OF THE INVENTION

The object of the present invention is to eliminate the above-mentioned problems and to provide a liquid-jet printer device with which a high degree of operational reliability is achieved.

The said object is achieved according to the present invention by a device of the aforementioned type which comprises means for maintaining an operating pressure in the supply conduit only during said printing periods during which printing occurs, and for pressure relief to atmospheric pressure or sub-atmospheric pressure during idle periods between the print moments, and means to achieve a small return flow of print liquid during said idle periods so that the outlet openings are substantially emptied of said liquid.

Preferred embodiments of the present invention are detailed in the dependent claims.

The invention will be described in more detail in the following, by way of example only, with reference to the attached drawings.

DETAILED DESCRIPTION

Figure 1:
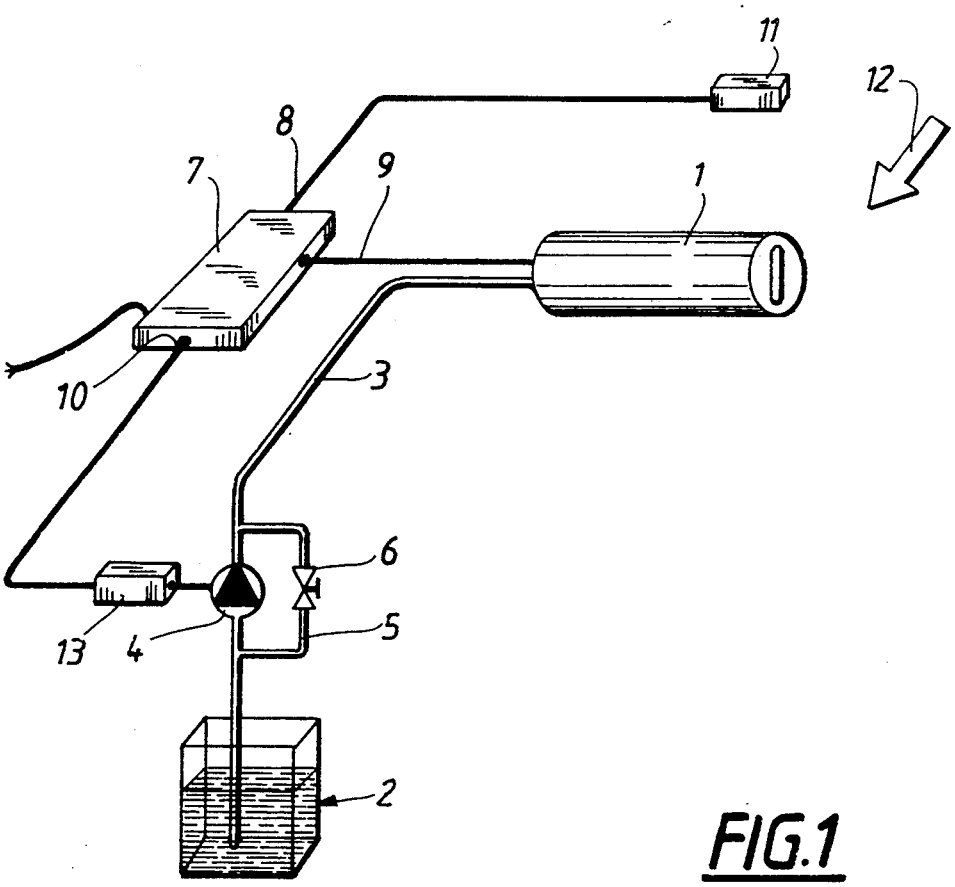
FIG. 1 shows a first embodiment of a liquid-jet printer device according to the invention.

A liquid-jet printer device according to the invention is shown in FIG. 1 and consists of an ink-jet printer with a print head 1, a liquid container 2 for ink and a supply conduit 3 for the delivery of ink from the liquid container 2 to the print head 1. The liquid delivery is ensured by a liquid pump 4 arranged in the supply conduit 3 since the liquid container 2 is positioned at a level below the level of the print head. Additionally, a bypass conduit 5 is arranged around the pump 4 with an adjustable throttle valve 6 which assures a reduced return flow of ink to the liquid container which shall be described in more detail below.

A control unit 7 is included in the printer device which, in the shown example, has a control input 8 and two control outputs 9,10. A sender 11 is connected to the control unit via the control input 8, which sender, for example a photo cell, detects the presence or absence of objects such as packaging boxes, onto which symbols or characters are to be printed. The objects are suitably transported on a conveyor in the direction of arrow 12, whereby the sender 11 is arranged to control the control unit such that the print head 1 is activated after a time delay so that characters are printed on the object when it passes in front of the print head 1. The side of the object which faces the print head accordingly constitutes the information carrier for that information which is printed by means of droplets of ink squirted onto the information carrier according to a pattern determined by the control unit 7.

The print head can consist of a matrix printer known per se and described for example in SE-8605348-5, which presents a plurality of channels which form a matrix of outlet openings within which a valve device for each channel is arranged to be individually switched between open and closed positions via electrical control using, for example, an electromagnet from control impulses which are emitted from the control unit via the control output 9. These channels each have an inlet end which together are connected to the supply conduit 3 for the supply of ink.

The control unit 7 is connected to an electrically driven drive means 13 for the pump 4, for example a motor, via the control output 10. The pump consists of, for instance, a gear pump which has a very quick start-up and which can, for example, build up required pressure in the supply conduit 3 to the print head 1 in a few seconds or fractions of a second. In order to achieve a transfer of liquid jets or liquid droplets from the print head 1 to the information carrier, a certain pressure accordingly needs to be built up in the supply conduit 3 and thus in the various channels of the print head which, by means of the in-built, not shown valves, are individually maintained open or closed depending on the character which is to be printed on the information carrier.

According to the invention, however, the pressure in the supply conduit and the channels in the print head before the valves is controlled such that the necessary pressure for the ink is maintained solely during the moment of printing, i.e. that moment during which character printing occurs, whilst pressure relief occurs during intervening idle periods, such as with a larger distance between characters on one and the same information carrier or with the period which occurs between each information carrier, i.e. objects which are fed past the printer. The required pressure in the supply conduit and print head is accordingly maintained during certain predetermined printing periods which are determined by the control unit 7, for example, based on information from the sender 11, whilst pressure relief occurs during the intervening idle periods.

In the first embodiment according to FIG. 1, the change between an operating pressure and an idle pressure is achieved via control of the liquid pump 4 so that it is maintained in operation, and through the pump pressure maintaining required operating pressure during those periods when the moment of printing is effected and being stopped during the idle periods. During these idle periods, pressure relief is allowed to occur either via a return flow through the pump itself or via the bypass conduit 5, whose throttle valve 6 permits a return flow down into the liquid container 2 since the container is at a lower level than the print head 1. Return flow can occur since the container 2 is not closed, but permits the liquid volume therein to be changed. The pressure in the print head is reduced to atmospheric pressure or a sub-atmospheric pressure during the idle periods, depending on the choice of sizes for the included components. In this way, undesired leakage through the valves in the print head to their outlet openings is eliminated since instead, capillary forces in both the supply conduit 3 and in the channels in the print head can "pull back" the liquid from the outlet openings during the idle periods, whereby the outlet openings and the region and the channels downstream of the valves in the print head are essentially emptied of ink so that the risk of blocking from congealed ink caused by drying-out is totally or partially greatly reduced.

Figure 2:
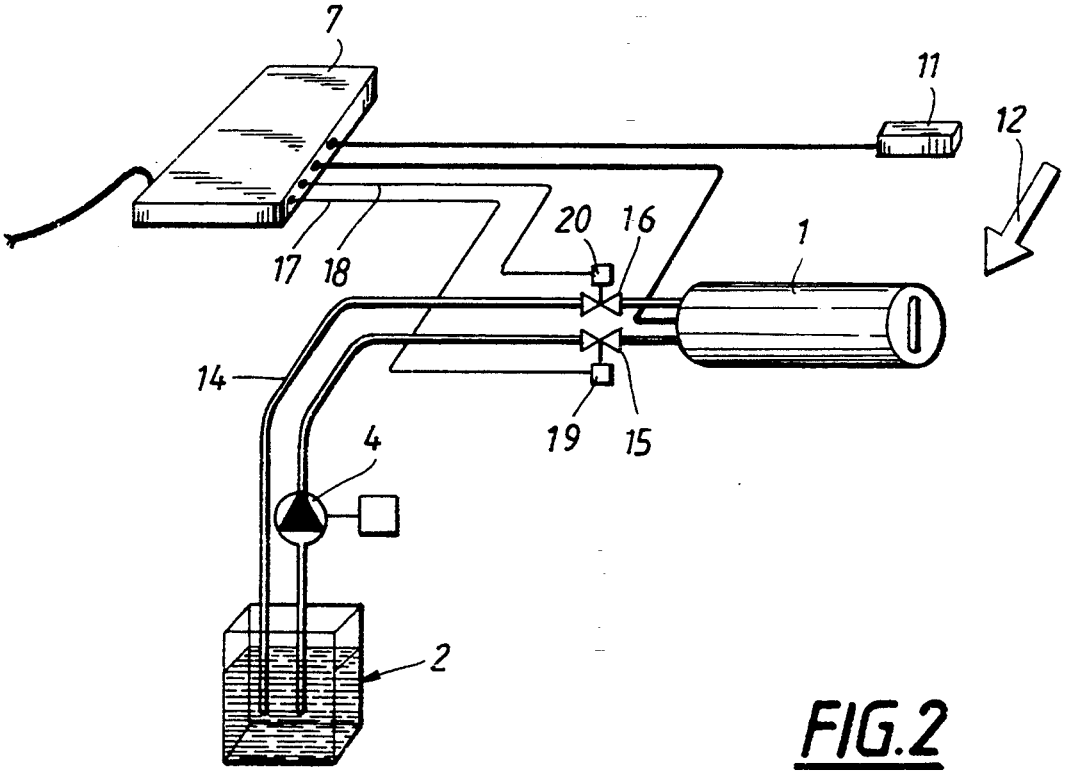
FIG. 2 shows a second embodiment of a liquid-jet printer device according to the invention.

The embodiment according to FIG. 2 presents, in addition to a supply conduit 3, a return conduit 14 which returns ink to the liquid container 2 during the idle periods. The liquid-jet printer hereby presents two valve assemblies 15,16, one for each conduit, whereby these valve assemblies are controlled for switching between open and closed positions respectively so that the print head is subjected to operating pressure during the moment of printing, whilst pressure relief occurs during the idle periods. Thus, the liquid pump 4 accordingly is not controlled, but instead continually maintains an operating pressure in the supply conduit before the valve assembly 15, whilst the control unit 7 with two outputs 17,18 is connected to drive means 19,20, such as electromagnets, for each of the valve arrangements for alternately switching these, which principally means that one is closed when the other is open. Both the supply conduit 3 and the return conduit 14 are connected to the liquid channels in the print head 1 so that during the moment of printing, liquid is supplied under pressure to the channels in the print head and, by means of the valves in the print head, is ejected dropwise or in liquid jets via associated outlet openings, whilst during idle periods the valve assembly 15 remains closed whilst the valve assembly 16 is kept open in order to achieve pressure relief by permitting return of liquid in the return conduit 14 to the liquid container.

Figure 3:
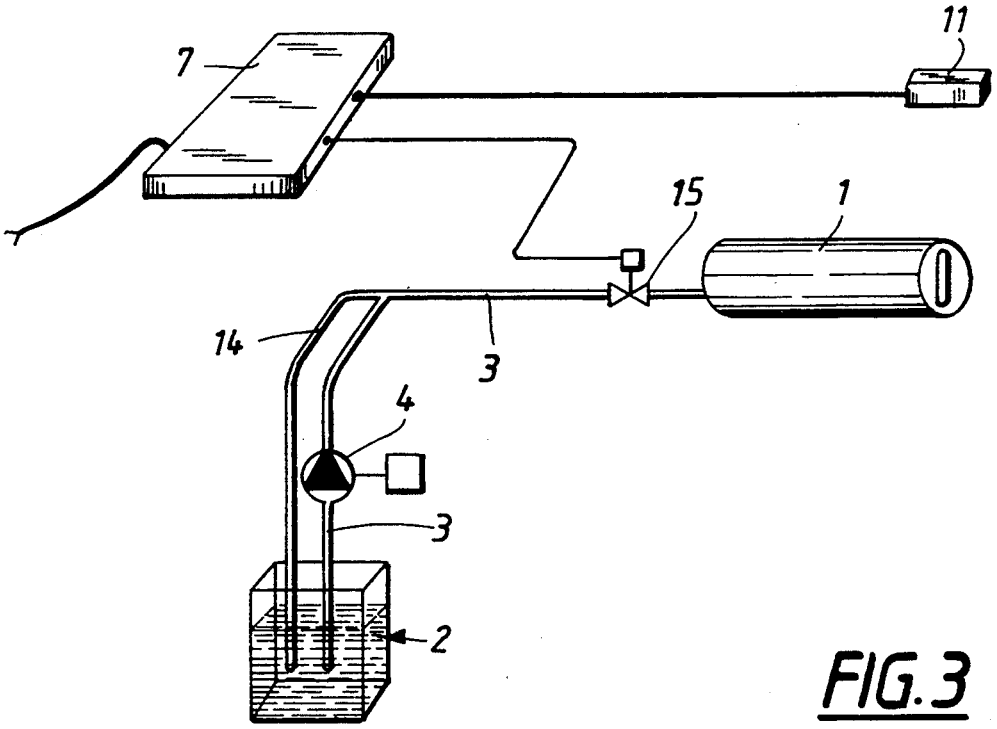
FIG. 3 shows a third embodiment of a liquid-jet printer device according to the present invention.

In the embodiment according to FIG. 3, a valve assembly 15, responsive to commands from the control unit 7, is located in the supply conduit 3 downstream of the pump 4. A return conduit 14 branches from said supply conduit 3 at a point between the pump 4 and the valve assembly 15. This return conduit forms a part of a recirculation circuit for the print liquid. In operation, the pump 4 constantly draws liquid from its container 2. When no printing is taking place, i.e. during idle periods, the valve assembly 15 is kept closed and the print liquid is thus made to flow from the pump 4, along the section of the supply conduit 3 up to the point where the return conduit 14 branches therefrom, and along said return conduit to the container 2.

When the control unit 7 receives information that printing is required, a command is sent to the valve assembly 15 which switches to the open position for the moment of printing. Thus, the necessary quantity of print liquid can flow through the valve assembly 15 and into the print head to be ejected onto the information carrier. At the same time, the remaining amount of liquid recirculates back to the container via the return conduit 14.

When the printing period is complete, the valve assembly 15 is closed. The valve assembly 15 is so designed, and the corresponding conduits so dimensioned, that, during closing, the liquid in the outlet openings of the print head 1 is "pulled back" so that the outlet openings are essentially emptied of ink. Thus, during the idle periods, the risk of blocking of the openings is effectively eliminated.

In a further, not shown embodiment of the invention, the pump 4 and the valve 6, or valves 15,16, are integrated in the print head 1. Thus, for the apparatus shown in FIG. 1, the only connections to the integrated print head would be the supply conduit 3 leading directly from the liquid container 2 and the control outputs 9,10 from the control unit 7. Naturally, if the control unit 7 were also integrated in the print head, then only one input 8 to the print head in addition to the supply conduit 3 would be required.

The invention is not restricted to the examples described above and shown in the drawings, but can be varied within the scope of the following claims. For instance, it is conceivable that instead of, or in addition to, pressure relief and return flow due to a difference in levels between the liquid container and the print head, the first embodiment be modified so that during the intervals in printing, the pump is reversed so as to pump in the other flow direction. In this way, the pump instead draws from the supply conduit, whereby a pressure drop is created in the print head and leakage through the valves in the print head in the direction towards the outlet openings is eliminated, since any remaining ink is sucked from the outlet openings in the print head. As a general rule, the valves in the print head are closed before pressure relief takes place. In a corresponding manner, the pressure is built up in the print head before, or substantially simultaneously with, the selected valves in the print head are opened for the printing. Whilst the pump 4 is shown in FIG. 2 as a suction pump, it is to be understood that a pump could be employed which applies a pressure to the surface of the liquid in a sealed container, with said liquid then exiting the container via a supply conduit leading to a valve assembly and thereafter to the print head.

What is claimed is:

1. A liquid-jet printer device for recording information on an information carrier in the form of characters or symbols including:

a print head in which a plurality of liquid channels are arranged to discharge a series of droplets of liquid according to a predetermined pattern during predetermined printing periods, each liquid channel having:

an outlet opening for discharge of the liquid under pressure;

a valve assembly arranged within each said liquid channel, the valve assembly being switchable for opening and closing the liquid channel; and an inlet for connection of the liquid channel to a supply conduit;

said printer device further comprising a pump arrangement to supply liquid under pressure to said supply conduit from a liquid source;

means for maintaining an operating pressure in the supply conduit only during said printing periods during which printing occurs, and for pressure relief to atmospheric pressure or sub-atmospheric pressure during idle periods between said printing periods; and means to achieve a small return flow of liquid during said idle periods so that the outlet openings are substantially emptied of said liquid.

2. The device as claimed in claim 1, wherein said liquid source is a liquid container positioned at a lower level than the print head.

3. The device as claimed in claim 2, wherein a return conduit is connected to the supply conduit at a location between the pump arrangement and the valve assembly and leads to the liquid source.

4. The device as claimed in claim 1, wherein said pump arrangement is arranged to be controlled intermittently by a control unit such that said pump arrangement is in operation only during said printing periods while said pump arrangement is at rest during said idle periods during which the return flow occurs.

5. The device as claimed in claim 4, wherein a bypass conduit having a throttle valve is connected to a supply conduit across the pump arrangement to ensure return flow of print liquid during idle periods.

6. The device as claimed in claim 4, wherein at least one of either the valve assemblies, the pump arrangement or the control unit is integrated within the print head.

7. The device as claimed in claim 1, wherein the pump arrangement is arranged to continuously maintain an operating pressure and that a valve assembly connected between the pump arrangement and the print head is arranged to be controlled by a control unit so as to be open during the printing periods and closed during the idle periods.

8. The device as claimed in claim 7, wherein said liquid source is a liquid container positioned at a lower level than the print head and a return conduit is connected between the print head and the liquid container and that a second valve assembly is connected therein and arranged to be controlled by the control unit so as to be essentially closed during the printing periods and open during the idle periods.

9. The device as claimed in claim 7, wherein a return conduit is connected to the supply conduit at a location between the pump arrangement and the valve assembly and leads to the liquid source.

10. The device as claimed in claim 1, wherein said pump arrangement is arranged to be controlled by a control unit such that the pump arrangement maintains operating pressure in the supply conduit to the print head during said printing periods and is reversed to the opposite flow direction during said idle periods.

* * * * *